US010480166B2

(12) United States Patent
Qu et al.

(10) Patent No.: US 10,480,166 B2
(45) Date of Patent: Nov. 19, 2019

(54) WATER DRAINER

(71) Applicant: Zhejiang Delifu Technology Co., Ltd., Ningbo (CN)

(72) Inventors: Jinglei Qu, Ningbo (CN); Guofei Wang, Ningbo (CN)

( * ) Notice: Subject to any disclaimer, the term of this patent is extended or adjusted under 35 U.S.C. 154(b) by 0 days.

(21) Appl. No.: 15/844,619

(22) Filed: Dec. 17, 2017

(65) Prior Publication Data

US 2019/0100905 A1 Apr. 4, 2019

(30) Foreign Application Priority Data

Sep. 29, 2017 (CN) ..... 2017 1 0907915

(51) Int. Cl.
*E03C 1/23* (2006.01)

(52) U.S. Cl.
CPC .... *E03C 1/2304* (2013.01); *E03C 2001/2311* (2013.01)

(58) Field of Classification Search
CPC ..... E03C 1/2304; E03C 2001/2311
USPC ..... 4/689, 690
See application file for complete search history.

(56) References Cited

U.S. PATENT DOCUMENTS

2006/0179564 A1* 8/2006 Jacobs ..... E03C 1/2304 4/689
2009/0255054 A1* 10/2009 Duncan ..... E03C 1/23 4/689
2009/0255055 A1* 10/2009 Duncan ..... E03C 1/23 4/689
2011/0099711 A1* 5/2011 Cerutti ..... E03C 1/23 4/689

FOREIGN PATENT DOCUMENTS

CN 202509584 U 10/2012

* cited by examiner

*Primary Examiner* — Huyen D Le
(74) *Attorney, Agent, or Firm* — W&K IP

(57) ABSTRACT

The present disclosure relates to the field of drainers, and to a drainer which allows draining of water without wetting or smearing a hand in the water of a cleaning basin. The drainer comprises a downcomer, a connecting pole, a connecting seat having a sewer outlet, and a sewer lid to close or open the sewer outlet. The connecting seat is connected to the downcomer. The connecting pole is inside the downcomer. The sewer lid is connected to an upper end of the connecting pole. A fixing seat is arranged on a side wall of the downcomer. A mounting housing is fixed to the fixing seat. A sliding block is slidably arranged in the mounting housing. A tilted block to support the connecting pole is arranged on end of the sliding block facing the connecting pole.

9 Claims, 18 Drawing Sheets

WATER DRAINER

CROSS-REFERENCE TO RELATED APPLICATIONS

This application claims priority to Chinese Patent Application No. 201710907915.4 with a filing date of Sep. 29, 2017. The content of the aforementioned applications, including any intervening amendments thereto, are incorporated herein by reference.

TECHNICAL FIELD

The present disclosure relates to the field of drainers, and more particularly, to a water drainer which allows disposing of water without wetting one's hand in the water of a cleaning basin.

BACKGROUND OF THE PRESENT INVENTION

Drainers are typically used in positions such as cleaning basins, lavatory basins, and washing tubs and constitute a major portion of kitchenware and toilet equipments. Currently available drainers typically comprise a rotatable sewer lid which is rotated to a horizontal direction to block a sewer outlet when the user wishes to reserve water. After usage, the user needs to reach his or her hand into the cleaning basin to rotate the sewer lid to a vertical direction to draw off the water from the cleaning base. Therefore, the hand must contact the water in the basin before the water can be drained. This process may be unpleasant and unhealthy in winter since the hand gets dirty after touching used water.

Hence, engineers have devised a drainer which allows opening and closing of the sewer lid by a first operational switch. For example, a sewer device for cleaning basins (Pat ent Number CN202509584U) has been disclosed by the State Intellectual Property Office. The sewer device comprises a first operational switch, a sewer plug mechanism, and a connecting steel wire. The first operational switch is provided with a vertically movable component and a button. One end of the connecting steel wire is connected to the vertically movable component. The first operational switch is provided with two staying positions where the vertically movable component may stay at different heights to retract the connecting steel wire. The sewer plug mechanism comprises a sewer lid and its lifting connecting pole. The other end of the connecting steel wire is connected to a drive mechanism which lifts the lifting connecting pole.

Although opening and closing of the sewer with the first operational switch is achieved in the patent above, there are still the following disadvantages:

1. Only two staying positions are provided for the first operational switch, so the functions of the sewer lid may only be switched between a closed state and an open state. As the user may have a variety of refined needs, the sewer lid is required to stay at an arbitrary position to control the draining rate of water. Such needs are not satisfied by the above patent.

2. The sewer can be switched to the closed state from the open state only by the first operational switch. In public areas, some may be accustomed to pressing the sewer lid with hands to close it. Since the limiting force for the open or closed sewer lid is provided by a limiting connector structure, pressing the sewer lid may cause damage to the product.

3. It is impossible to remove the sewer plug mechanism as a whole during cleaning.

SUMMARY OF PRESENT INVENTION

The present disclosure is aimed to solve at least one the above disadvantages.

The technical problem to be solved by the present disclosure is to provide a water drainer which allows draining without touching water in the cleaning base and wetting one's hands.

The drainer of the present disclosure comprises a drainer including a downcomer, a connecting pole, a connecting seat having a sewer outlet, and a sewer lid to close or open the sewer outlet. The connecting seat is connected to the downcomer. The connecting pole is inside the downcomer. The sewer lid is connected to an upper end of the connecting pole. A fixing seat is arranged on a side wall of the downcomer. A mounting housing is fixed to the fixing seat. A sliding block is slidably connected within the mounting housing. A tilted block to support the connecting pole is arranged on end of the sliding block facing the connecting pole. A driving component to actuate the sliding motion of the sliding block is arranged within the mounting housing. The tilted block pushes the connecting pole and the sewer lid upwards to open the sewer outlet when the sliding block slides towards the connecting pole.

Advantages of the above structure are listed below. The tilted block pushes the connecting pole and the sewer lid upwards to open the sewer outlet when the sliding block slides towards the connecting pole, and when the sliding block slides away from the connecting pole, the connecting pole and the sewer lid move downwards due to gravity and seal the sewer outlet. The structures of the sliding block pushing the connecting pole allows opening and closing of the sewer lid by controlling the driving component to drive the sliding motion of the sliding block. It is thus advantageous to achieve draining of water without wetting the hand in the water of a cleaning basin. Further, the user can still press the sewer lid to lower and close it since the sliding block can slide back and forth. Situations of the prior arts where the sewer lid is damaged by hard pressing can be avoided since the sewer lid is no longer driven to lift or decline only by a corresponding switch.

Based on the above disclosure, the contacting surface of the tilted block and the connecting pole is a supporting face which is an inclined surface and/or a curved surface.

In some embodiments, a pulley rotatably connected to the tilted block is rotatably connected to a lower end of the connecting pole. The rotatable pulley allows a more smooth vertical movement of the connecting pole. Of course, the embodiment can also be implemented using a sphere arranged on the lower end of the connecting pole.

In some embodiments, an elastic snap joint is arranged on a lower end of the connecting pole, the elastic snap joint comprises a bayonet connected to the tilted block, and the pulley is rotatably arranged within the elastic snap joint. Several disadvantages are caused if the elastic snap joint is not provided. Firstly, the tilted block pushes the connecting pole upwards too hard and causes the connecting pole to leap when the driving component drives the sliding block to slide in an overly high speed. Secondly, it is liable to remove the connecting pole and the sewer lid altogether when the connecting pole moves upwards to open the sewer lid. If the drainer is deployed in public areas, the connecting pole and the sewer lid may be lost. By deploying the elastic snap joint, the tilted block is placed within the bayonet to limit the leap of the connecting pole. Further, a substantial amount of force is needed to remove the connecting pole and the sewer lid from the elastic snap joint. Cleaning becomes more convenient and losses can be reduced.

In some embodiments, a guiding component to guide the tilted block to enter the bayonet is arranged on a lower end of the elastic snap joint.

In some embodiments, the driving component comprises a driving block, a connecting wire and a driving unit to retract the connecting wire. The driving block is slidably arranged within the mounting housing. An end of the driving block is connected to the connecting wire. The connecting wire is connected to the driving unit. The driving unit actuates the driving block to slide using the connecting wire. A rack and pinion transmission component is arranged between the driving block the sliding block, and the driving block actuates the sliding block to slide through the rack and pinion transmission component. In such a way, the driving unit can be mounted on the surface of cleaning basin. By pulling the driving unit into action, the driving block drives the sliding block to slide by the rack and pinion transmission component. This mechanical structure has a friction force which holds the sliding block in position and the sewer lid along with it when the driving unit stays in a certain position. The sewer can be held in different positions by adjusting the driving unit to different positions. Therefore, an adjustable covering area of the sewer lid relative to the sewer outlet is achieved. The covering area can be conveniently adjusted by operating the driving unit. The embodiment provides an advantage over prior arts which offer a sewer lid switchable only between an open state and a closed state.

In some embodiments, the rack and pinion transmission component comprises a first rack arranged on the driving block, a second rack arranged on the sliding block and a transmission pinion rotatably arranged within the mounting housing, and both the first rack and the second rack are engaged with the transmission pinion.

In some embodiments, the driving unit comprises a handle vertically moveable to retract the connecting wire during vertical movements of the handle. The transmission pinion comprises a first driving wheel, a second driving wheel and a third driving wheel arranged in parallel. The first driving wheel is engaged with the second driving wheel. The second driving wheel is engaged with the third driving wheel. The length of the second driving wheel is less than the length of each of the third driving wheel and the first driving wheel. The first rack is engaged with the first driving wheel. The second rack is engaged with the third driving wheel. Gaps are arranged on the first rack and the second rack to provide space for the second driving wheel. The transmission pinion is devised to comprise a first driving wheel, a second driving wheel, and a third driving wheel. As the handle is pulled upwards, the sliding block slides towards the connecting pole and the tilted block pushes the connecting pole and the sewer lid upwards to open the sewer outlet. As the handle is pulled downwards, the sliding block slides away from the connecting pole, and the connecting pole and the sewer lid move downwards due to gravity until the sewer outlet is sealed. Having the handle pulled upwards to open the sewer lid and having the handle pulled downwards to close the sewer lid conform to human habits. There should be an odd number of transmission pinions, such, as one, three, or five transmission pinions. Additionally, the length of the second transmission pinion is less than the first transmission pinion and the third transmission pinion. The gaps arranged on the first and second racks to provide space for the second transmission pinion are devised to ensure coordination of the racks and the pinions in a limited space within the mounting housing.

In some embodiments, the mounting housing comprises a first housing and a second housing connected to each other, the first housing comprises a pin to rotatably connect to the transmission pinion, the second housing comprises a via arranged correspondingly to the pin, and the pin is riveted to the second housing through the via. The first housing and the second housing can form a mounting housing by connection. Assembly and manufacture efficiencies can be increased by the one-time mounting process of the transmission pinion.

In some embodiments, the mounting housing is screwed to the fixing seat by a fastening component, a first latch is arranged on the end face of the fixing seat, a second latch is arranged on the ends of the fastening component, and the first latch is engaged with the second latch. For example, the first latch comprises teeth inverse to that of the second latch. Therefore, the loosening of the fastening component can be avoided when fastening the fastening component to the fixing seat, further enhancing robustness of the drainer in usage.

In some embodiments, a circumferential limiting structure is provided on the fixing seat and the mounting housing. The circumferential limiting structure comprises notches on the fixing seat and ribs connected to the notches. This configuration avoids rotation of the mounting housing, and ensures stability of the drainer during usage. In another aspect, this configuration ensures an accurate orientation and position of the tilted block when the mounting housing is mounted behind the fixing seat.

Figure 1:
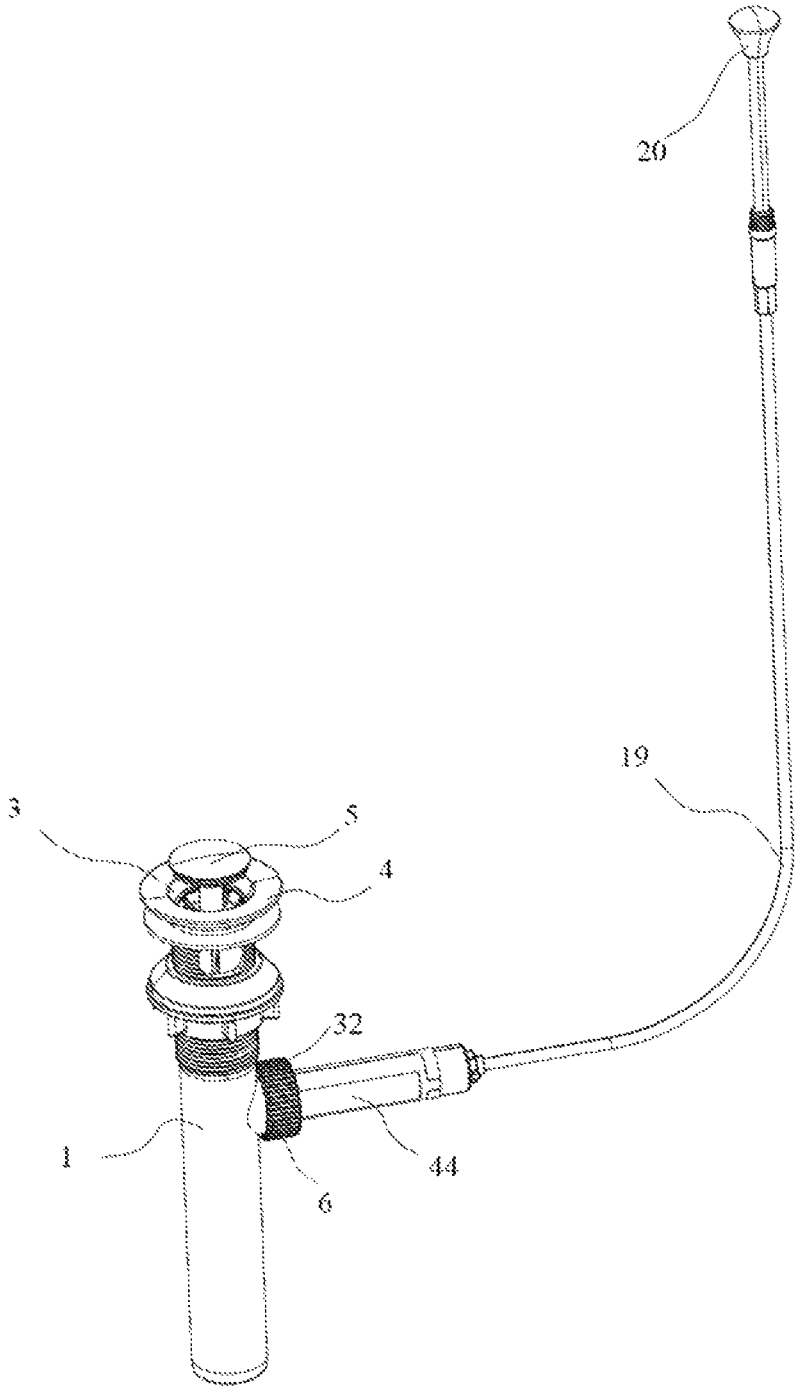
FIG. 1 is a structural schematic of a drainer according to an embodiment.
Figure 2:
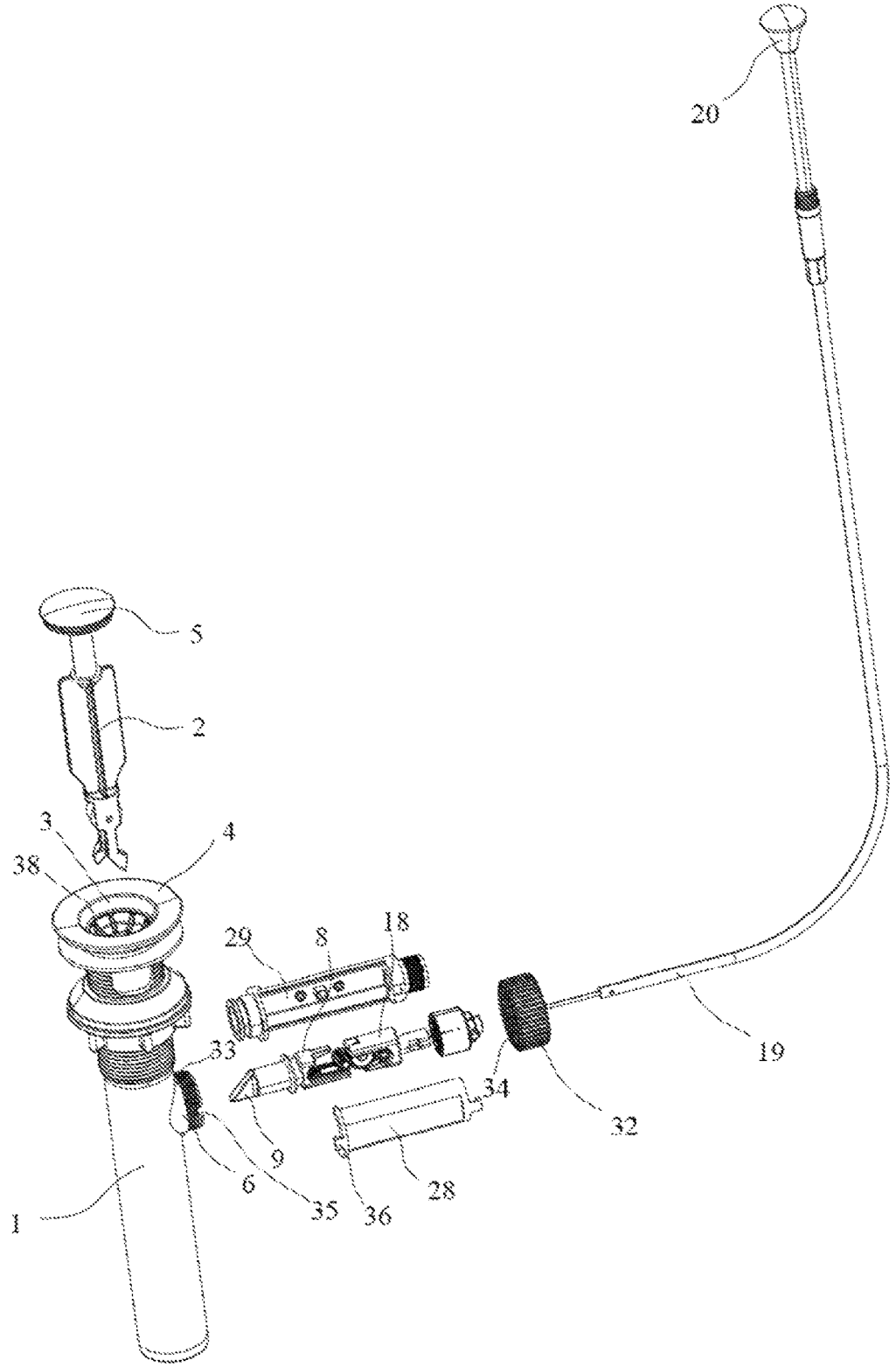
FIG. 2 is an explosive view of a drainer according to an embodiment.
Figure 3:
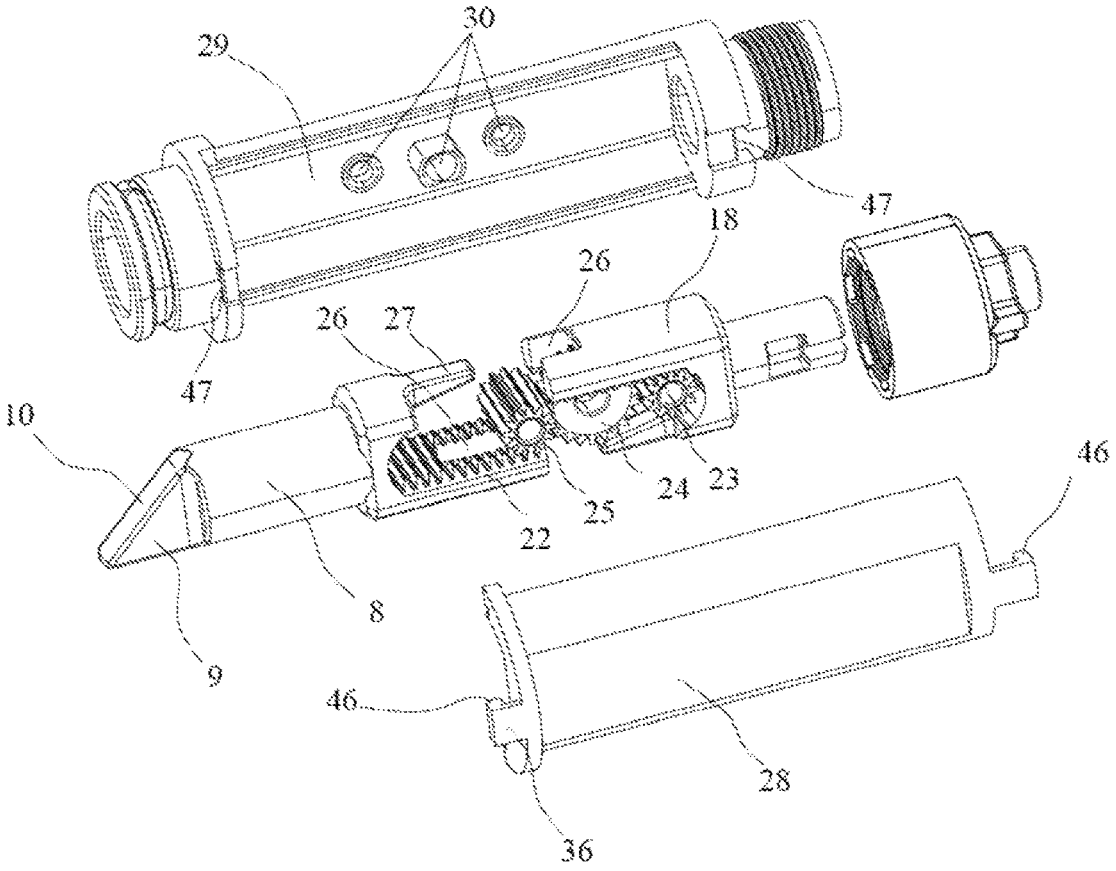
FIG. 3 is an explosive view of a mounting housing of a drainer according to an embodiment.

Reference Numbers: 1 downcomer, 2 connecting pole, 3 sewer outlet, 4 connecting seat, 5 sewer lid, 6 fixing seat, 7 mounting housing, 8 sliding block, 9 tilted block, 10 supporting face, 11 pulley, 12 sphere, 13 elastic snap joint, 14 bayonet, 15 first guiding block, 16 second guiding block, 17 guiding face, 18 driving block, 19 connecting wire, 20 handle, 21 first rack, 22 second rack, 23 first transmission pinion, 24 second transmission pinion, 25 third transmission pinion, 26 gap, 27 limiting plugs, 28 first housing, 29 second housing, 30 via, 31 pin, 32 fastening component, 33 first latch, 34 second latch, 35 notch, 36 fixing block, 37 sealing ring, 38 filter, 39 directing plate, 40 directing rib, 41 directing groove, 42 limiting rib, 43, slide-in guiding rib, 44 driving mechanism, 45 guiding bar, 46 hook, 47 connecting groove.

DETAILED DESCRIPTION OF PREFERRED EMBODIMENTS

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific numbers, materials, and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

In addition, the terms "first", "second", and "third" are for illustrative purposes only and are not to be construed as indicating or implicit relative importance.

In the descriptions of the present disclosure, it is to be understood that the terms "provided", "mounted", "arranged", "connected" should be understood in a broad sense unless otherwise expressly defined and specified. For example, it may be a fixed connection, a detachable connection, an integrated connection, a mechanical connection, an electrical connection, a direct connection, an indirect connection through a media or an interconnection between two parts. The terms can be construed according to the understanding of one commonly skilled in the art.

As shown in FIG. 1-18, a drainer of an embodiment comprises a downcomer 1, a connecting pole 2, a connecting seat 4 having a sewer outlet 3, and a sewer lid 5 to close or open the sewer outlet 3. The connecting seat 4 is connected to the downcomer 1. The connecting pole 2 is inside the downcomer 1. The sewer lid 5 is connected to an upper end of the connecting pole 2. A fixing seat 6 is arranged on a side wall of the downcomer 1. A mounting housing 7 is fixed to the fixing seat 6. A sliding block 8 is slidably arranged within the mounting housing 7. A tilted block 9 to support the connecting pole 2 is arranged on end of the sliding block 8 facing the connecting pole 2. A driving component to actuate the sliding motion of the sliding block 8 is arranged within the mounting housing 7. When the sliding block 8 slides towards the connecting pole 2, the tilted block 9 pushes the connecting pole 2 and the sewer lid 5 upwards to open the sewer outlet 3.

The mounting housing 7, the sliding block 8 and the tilted block 9 together form an integer of a driving mechanism 44 to lift or lower the connecting pole 2. The contacting surface of the tilted block 9 and the connecting pole 2 is a supporting face 10 which is an inclined surface and/or a curved surface.

Figure 4:
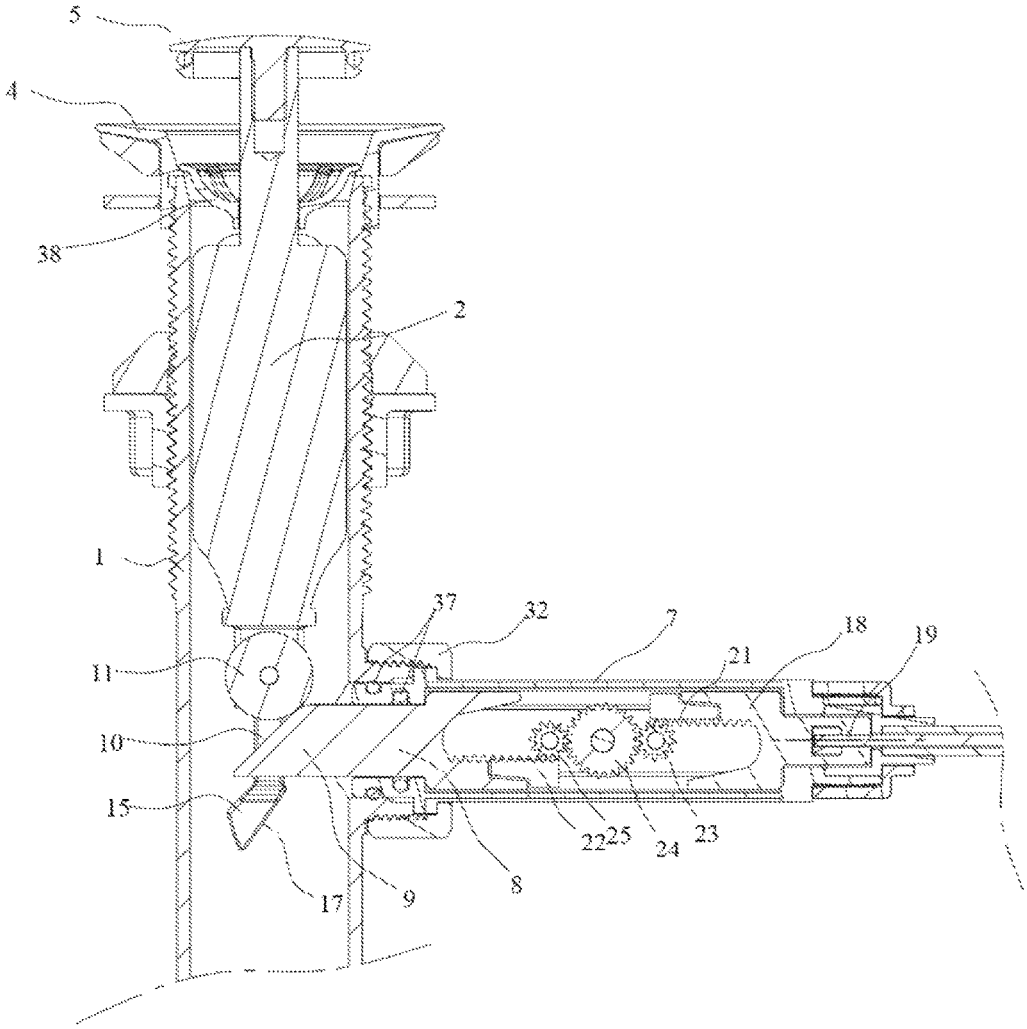
FIG. 4 is a cross-section of an opened sewer outlet of a drainer according to an embodiment.
Figure 5:
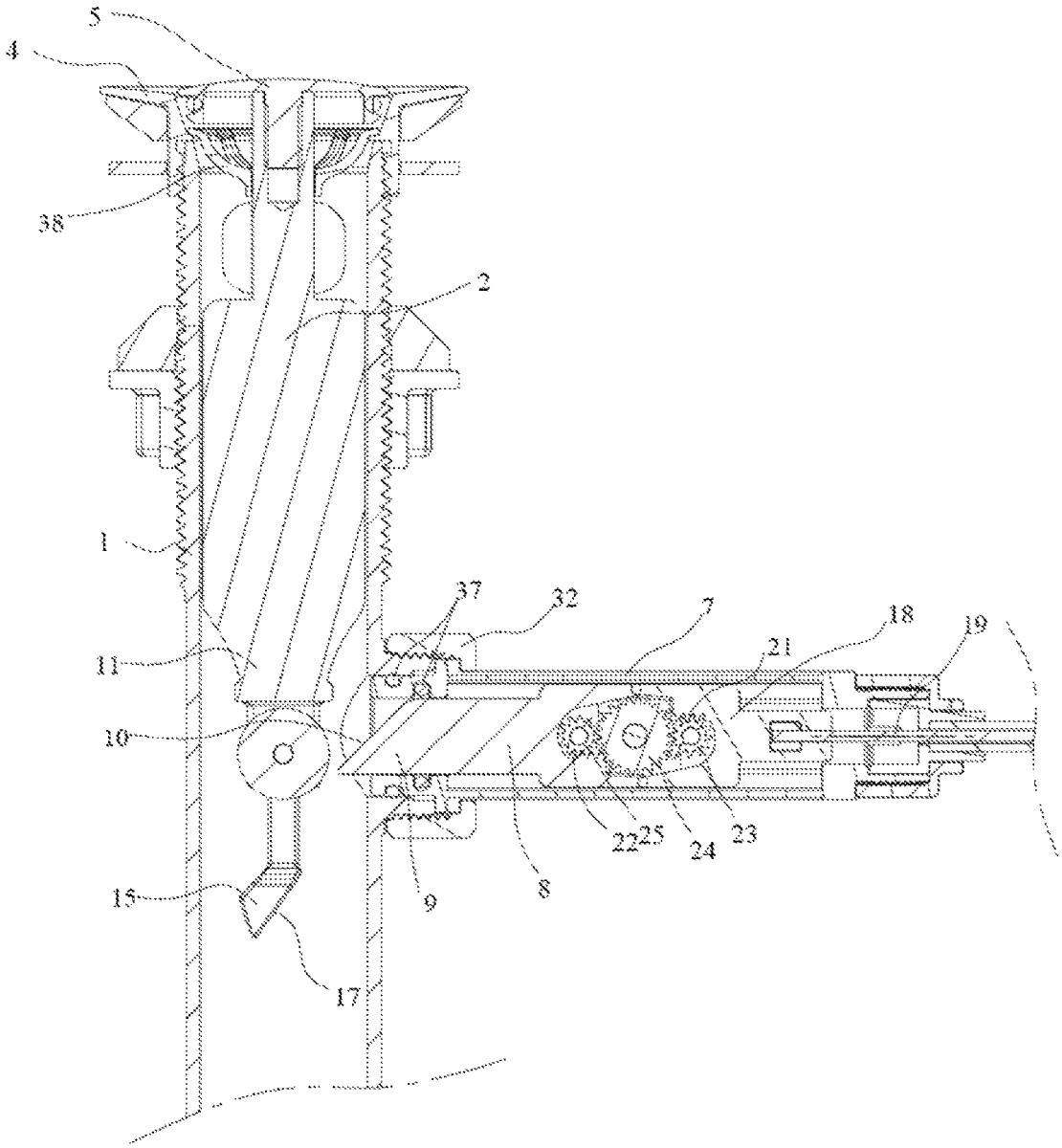
FIG. 5 is a cross-section of a closed sewer outlet of a drainer according to an embodiment.
Figure 6:
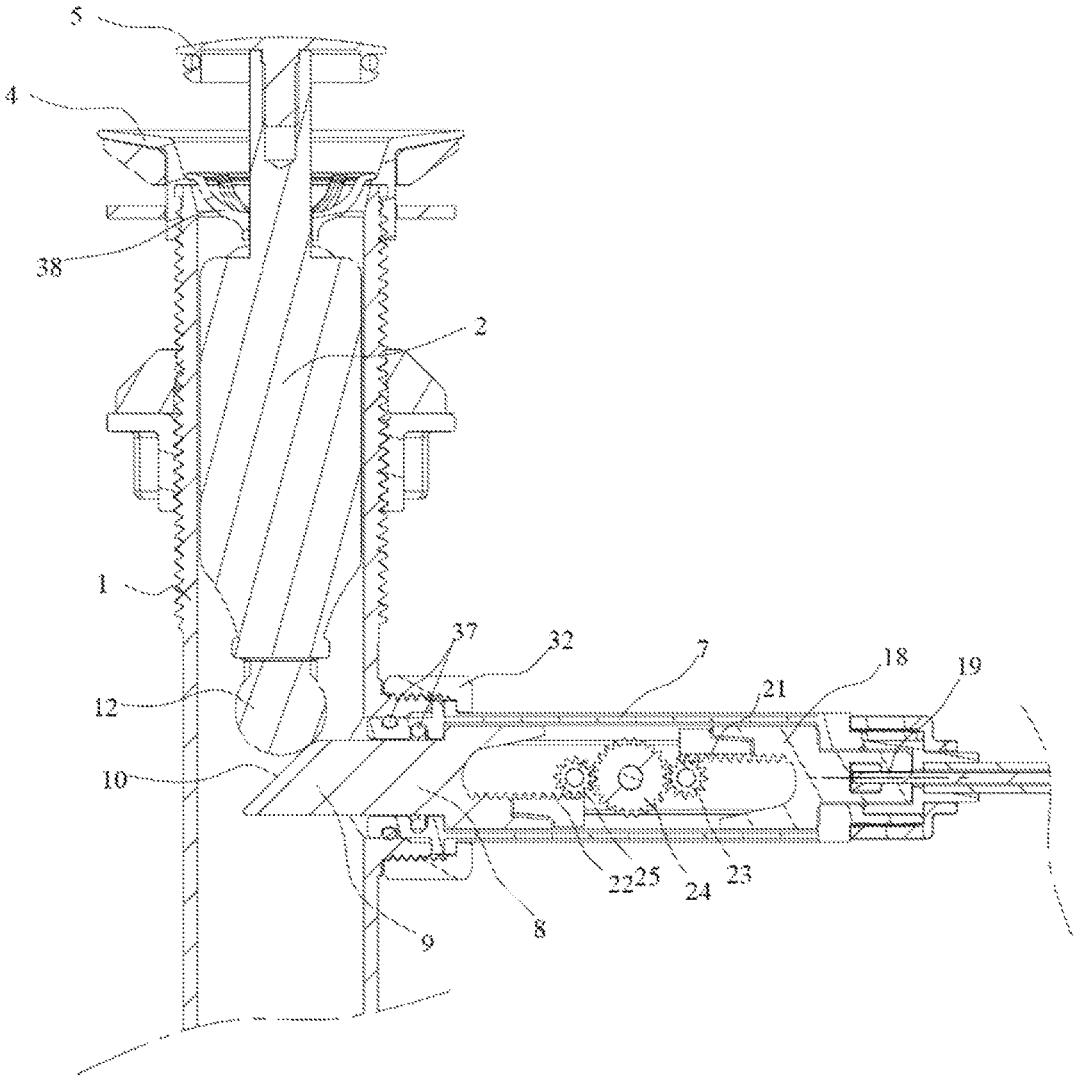
FIG. 6 is a cross-section of a connecting pole of a drainer provided with a sphere on a lower end according to an embodiment.
Figure 7:
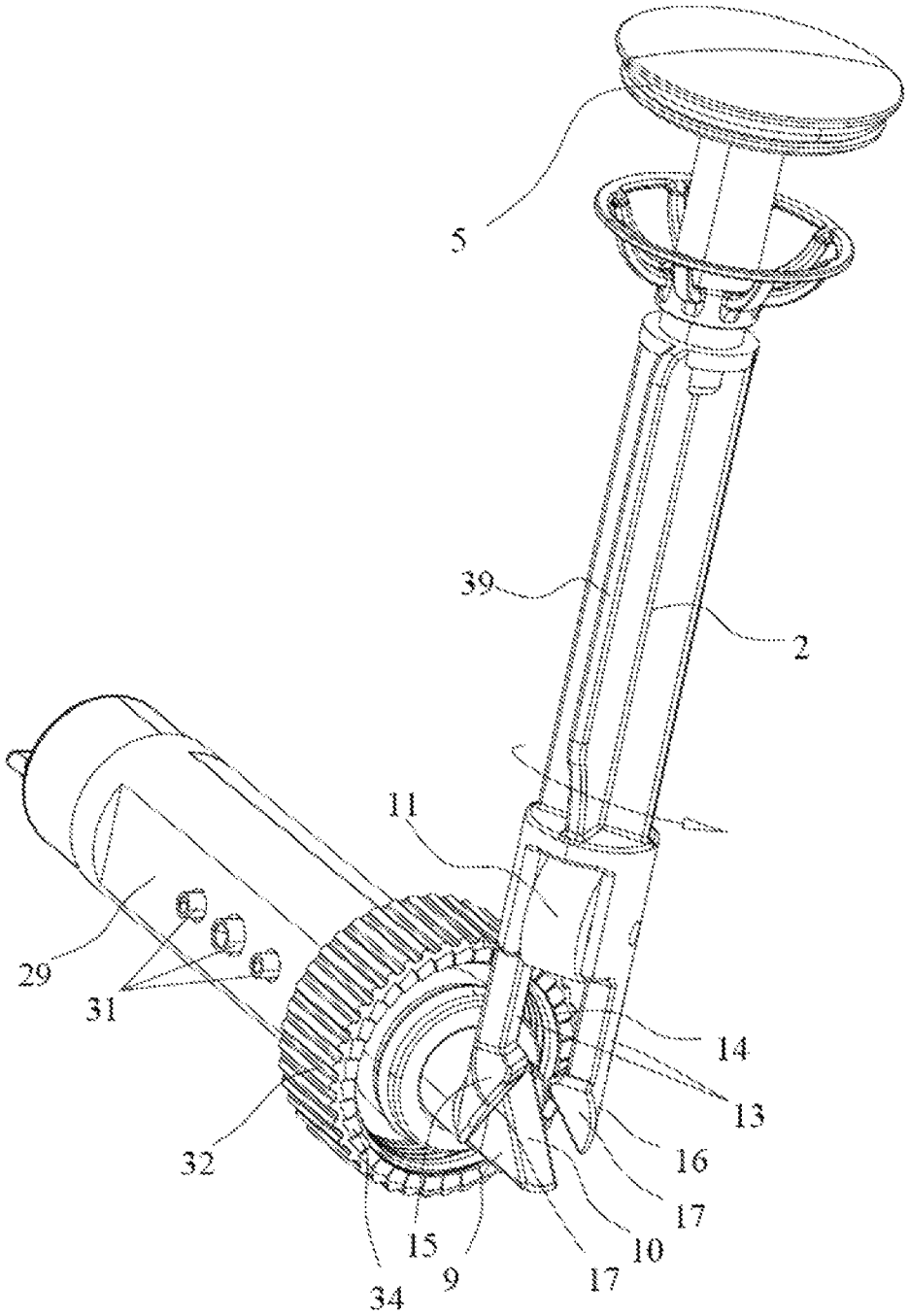
FIG. 7 is a structural schematic of an elastic snap joint rotated by a guiding component and a tilted block of a drainer according to an embodiment.
Figure 8:
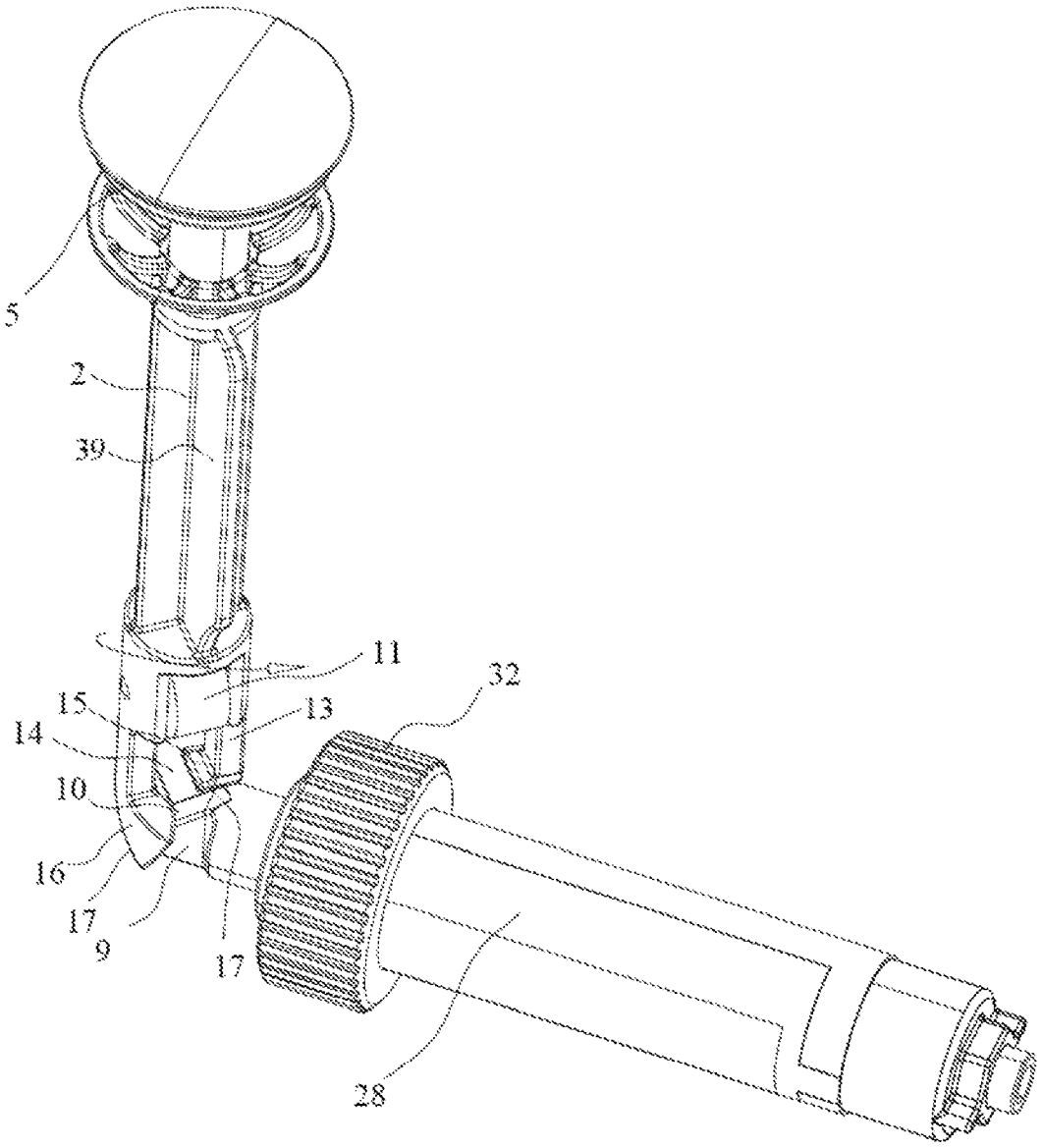
FIG. 8 is another perspective of an elastic snap joint rotated by a guiding component and a tilted block of a drainer according to an embodiment.
Figure 9:
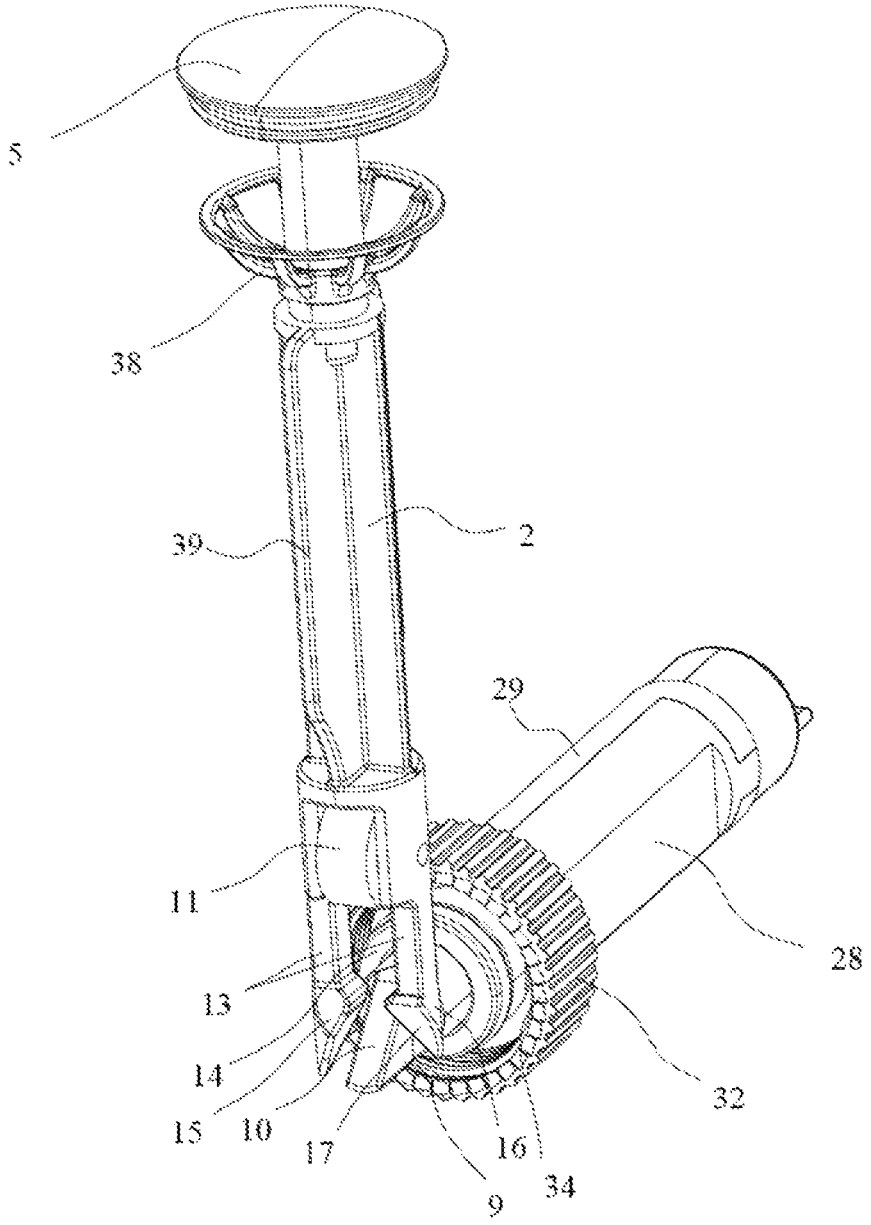
FIG. 9 is a structural schematic of an elastic snap joint rotated by a guiding component and a tilted block of a drainer according to an embodiment to a position where the tilted block fits in a bayonet.
Figure 10:
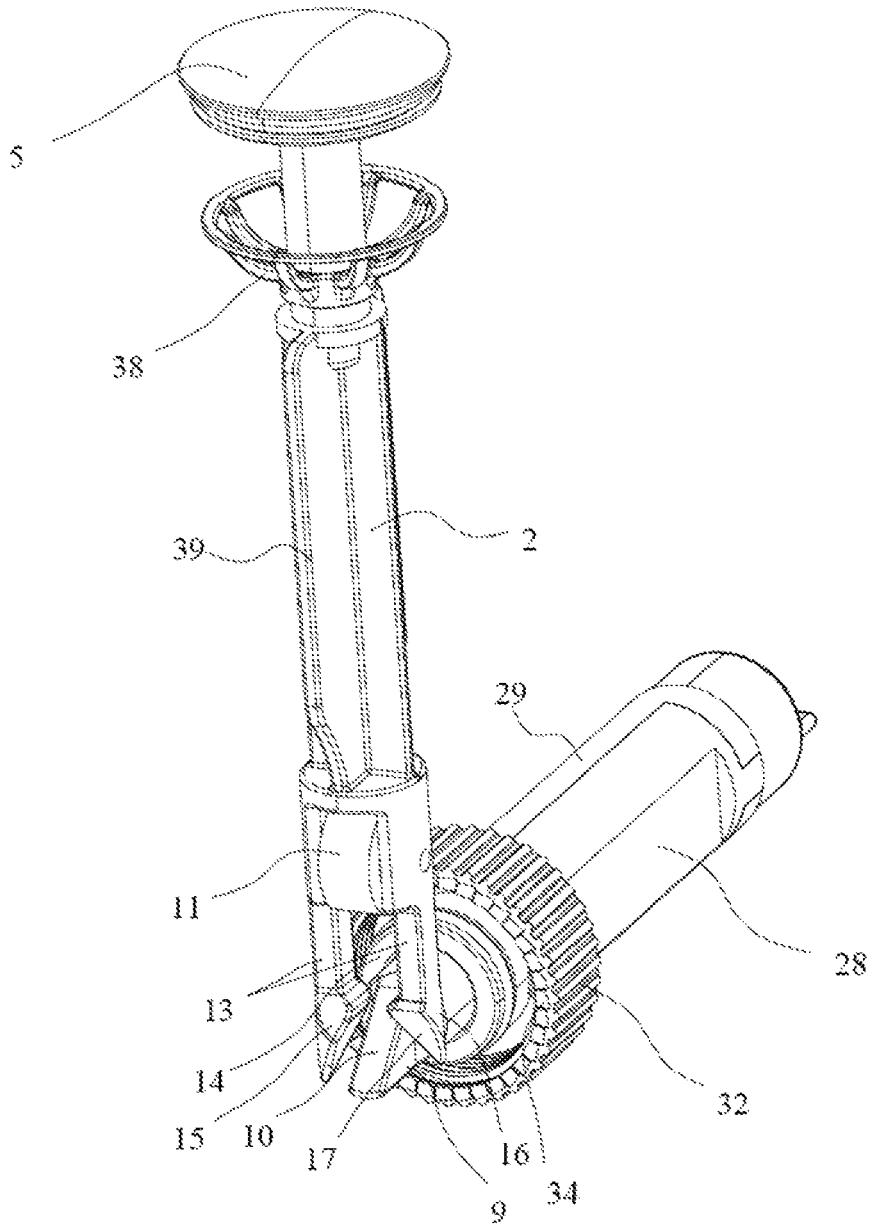
FIG. 10 is a structural schematic of a tilted block fitted in a bayonet of drainer according to an embodiment.
Figure 11:
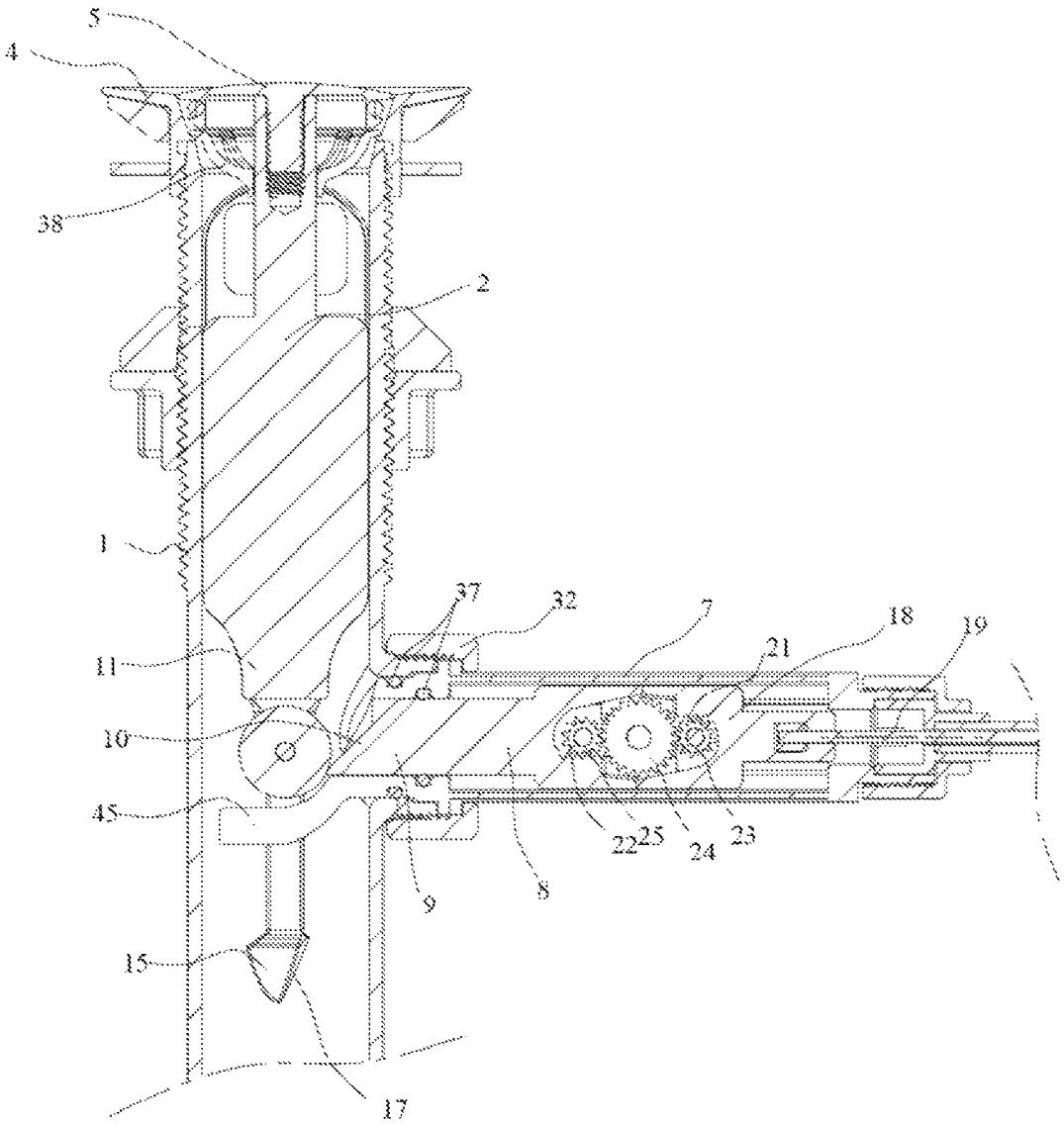
FIG. 11 is a cross-section of a guiding bar of a drainer according, to an embodiment.
Figure 12:
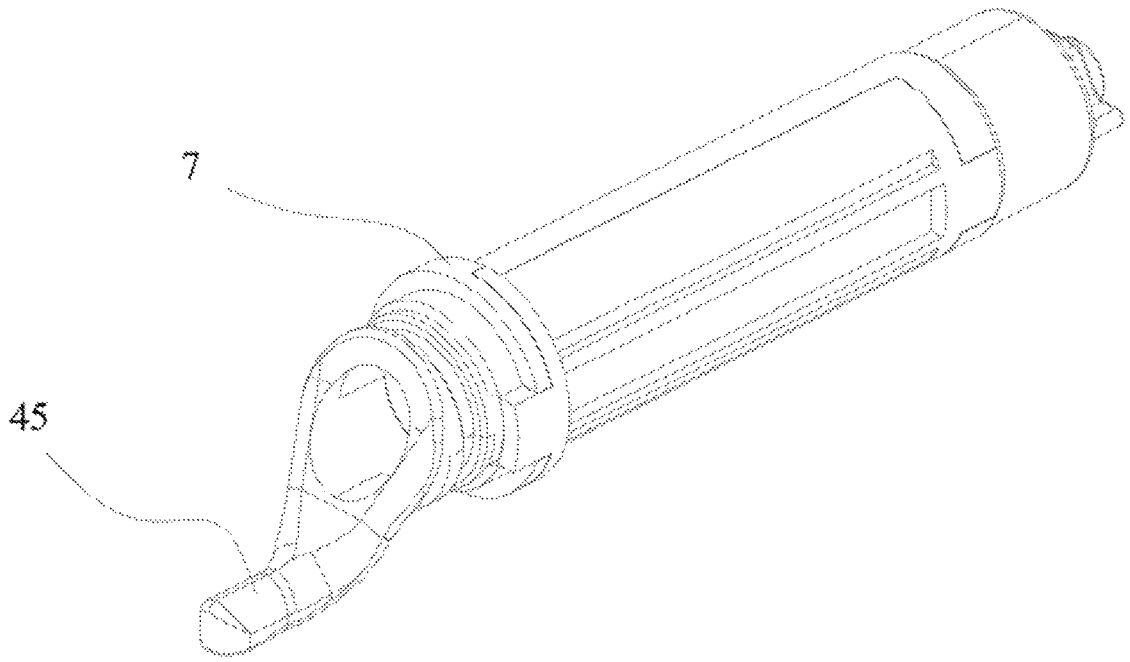
FIG. 12 is a structural schematic of a mounting housing comprising a guiding bar according to an embodiment.

In embodiments as shown in FIG. 4-5, a pulley 11 is rotatably connected to the tilted block 9. The pulley is also rotatably connected to a lower end of the connecting pole 2. In such a way, the rotatable pulley allows a more smooth vertical movement of the connecting pole 2. Of course, the embodiment can also be implemented using a sphere 12 arranged on the lower end of the connecting pole as shown in FIG. 6.

An elastic snap joint 13 is arranged on a lower end of the connecting pole 2. The elastic snap joint 13 comprises a bayonet 14 connected to the tilted block 9, and the pulley 11 is rotatably arranged within the elastic snap joint 13. Several disadvantages are caused if the elastic snap joint 13 is not provided. Firstly, the tilted block 9 pushes the connecting pole 2 upwards too hard and causes the connecting pole 2 to leap when the driving component drives the sliding block 8 to slide in an overly high speed. Secondly, it is liable to have the connecting pole 2 and the sewer lid 5 removed altogether when the connecting pole 2 moves upwards to open the sewer lid 5. If the drainer is deployed in public areas, the connecting pole 2 and the sewer lid 5 may be lost. By deploying the elastic snap joint 13, the tilted block 9 is placed within the bayonet 14 to limit the leap of the connecting pole 2. Further, a substantial amount of force is needed to remove the connecting pole 2 and the sewer lid 5 from the elastic snap joint 13. Losses of the connecting pole 2 and the sewer lid 5 can become less likely.

A guiding component to guide the tilted block 9 to enter the bayonet 14 is arranged on a lower end of the elastic snap joint 13. As shown in FIG. 7-10, the guiding component comprises a first guiding block 15 and a second guiding block 16 arranged on a lower end of the elastic snap joint 13. Guiding faces 17 are provided on the ends of the first guiding block 15 and the second guiding block 16 which are facing downwards. Each guiding face 17 can be an inclined surface with one end higher than the other end, a spiral surface, or a curved surface. The guiding faces 17 on the first guiding block 15 and the second guiding block 16 are of dovetail shape. The guiding faces 17 on the first guiding block 15 and the second guiding block 16 are centrosymmetrically deployed. As the first guiding block 15 and the second guiding block 16 are in contact with the tilted block 9, the guiding faces 17 on the first guiding block 15 and the second guiding block 16 are positioned on the two sides of the tilted block 9, respectively. During assembly, the mounting housing 7 is firstly fixed to the fixing seat 6, and then the connecting pole 2 is inserted into an end of the downcomer 1. It would have been difficult to observe inside the downcomer 1. By utilizing the above configuration, the elastic snap joint 13 will rotate due to gravity of the connecting pole 2 and the sewer lid 5 if the bayonet 14 of elastic snap joint 13 is not positioned correctly after the guiding faces 17 contact the tilted block 9. The elastic snap joint 13 stops when the tilted block 9 fits in the bayonet 14. After that, a certain amount of force can be applied to pushes the tilted block 9 into the bayonet 14 and complete the assembly.

Figure 13:
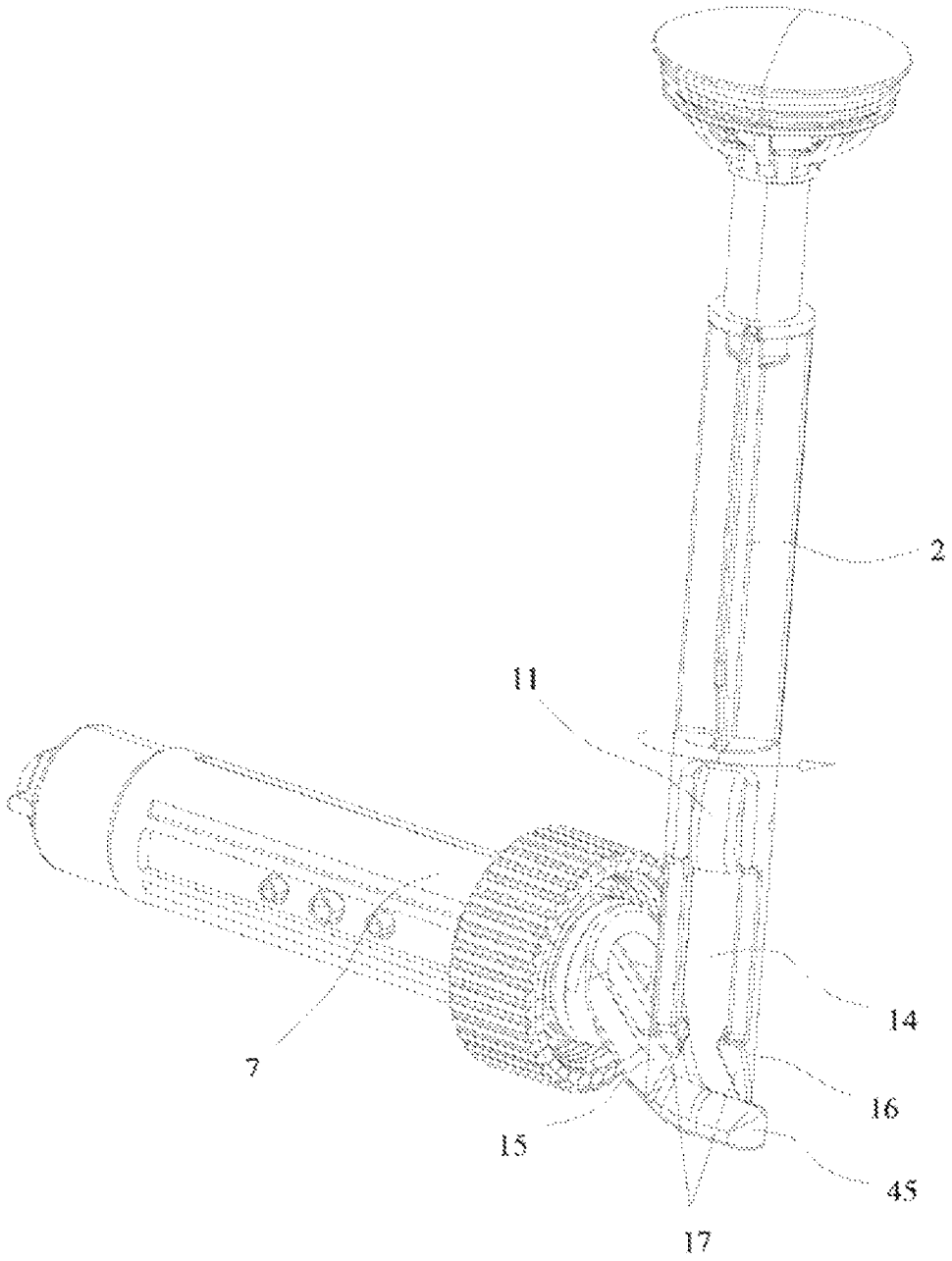
FIG. 13 is a structural schematic of an elastic snap joint rotated by a guiding component and a guiding bar of a drainer according to an embodiment.
Figure 14:
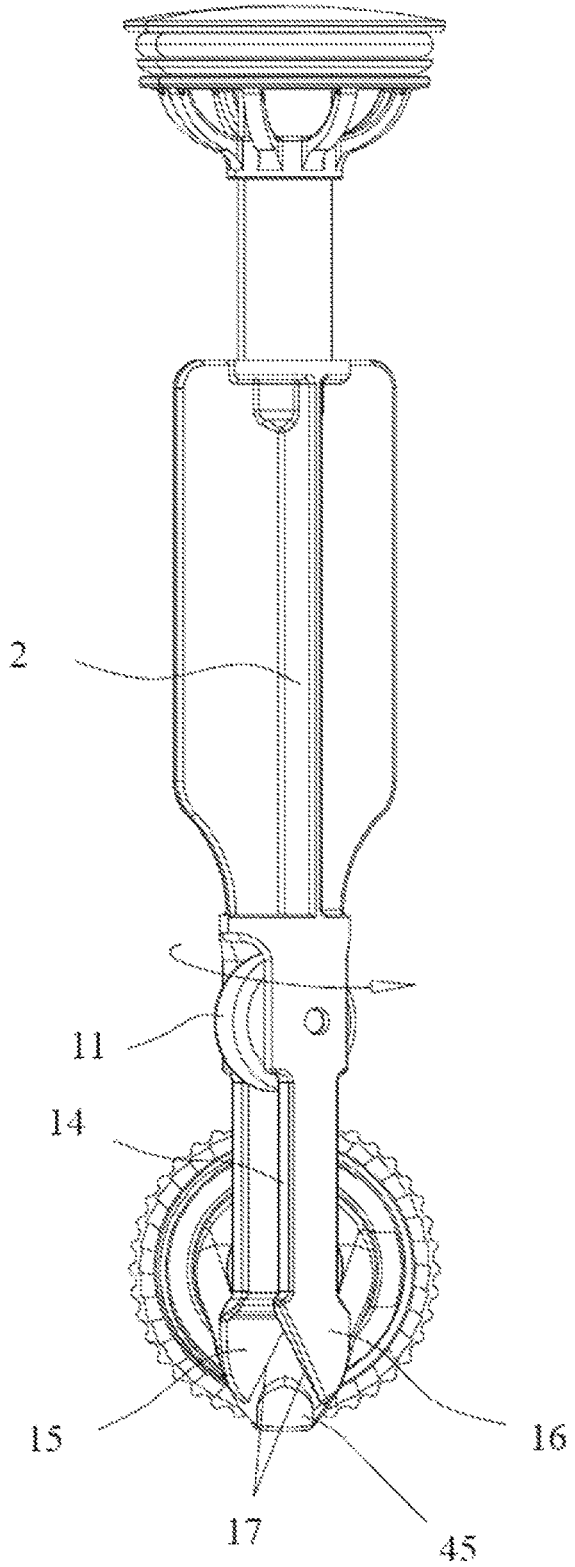
FIG. 14 is a main view of an elastic snap joint rotated by a guiding component and a guiding bar of a drainer according to an embodiment.
Figure 15:
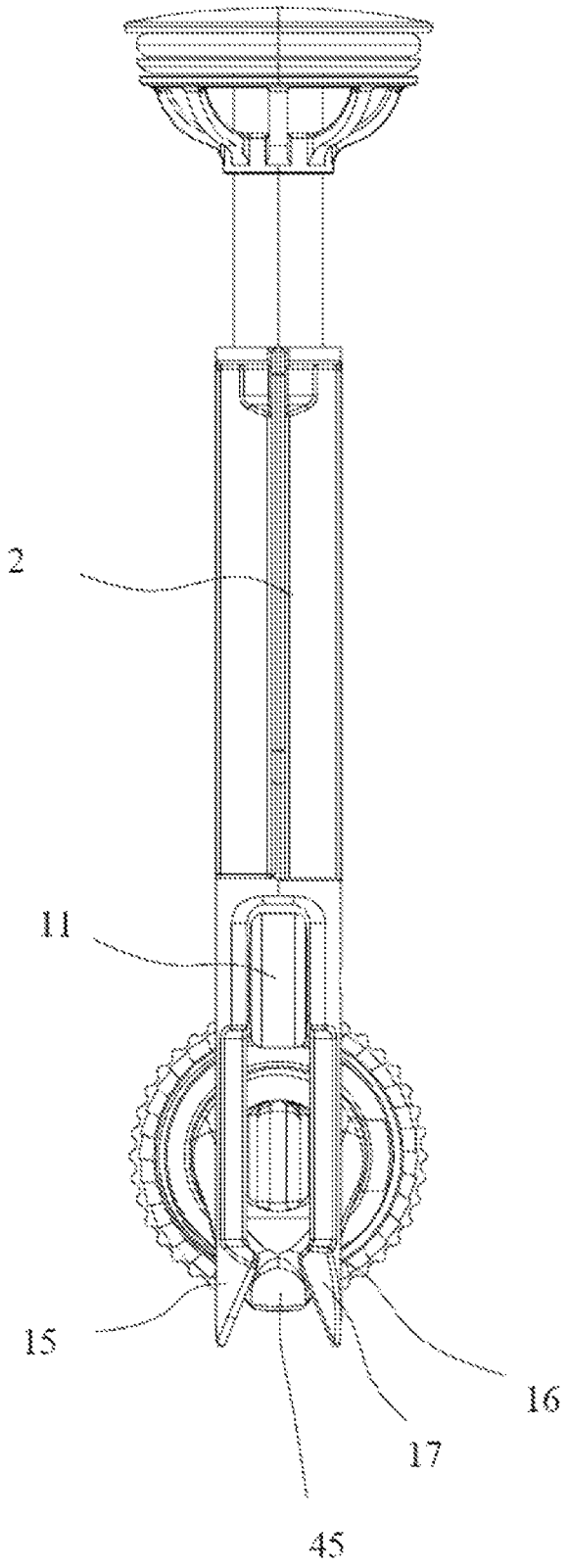
FIG. 15 is a main view of an elastic snap joint rotated by a guiding component and a tilted block of a drainer according to an embodiment to a position where the guiding bar fits in a bayonet.
Figure 16:
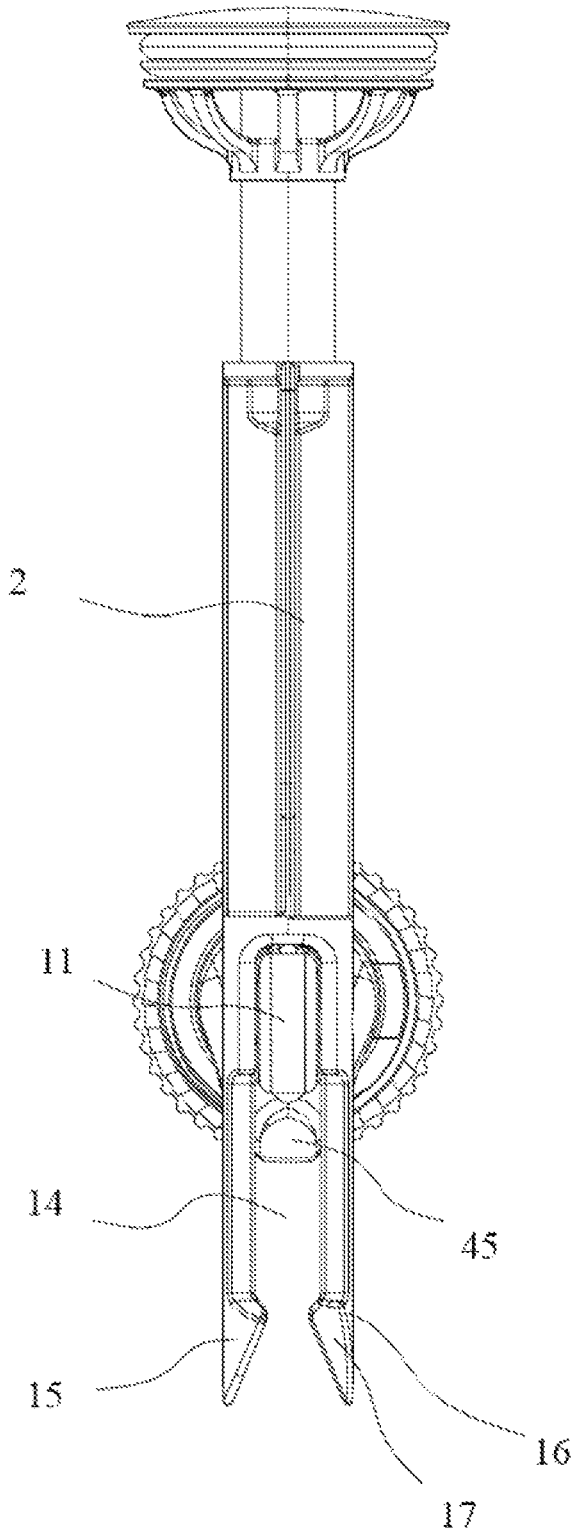
FIG. 16 is a main view of a guiding bar of a drainer fitted into a bayonet according to an embodiment.
Figure 17:
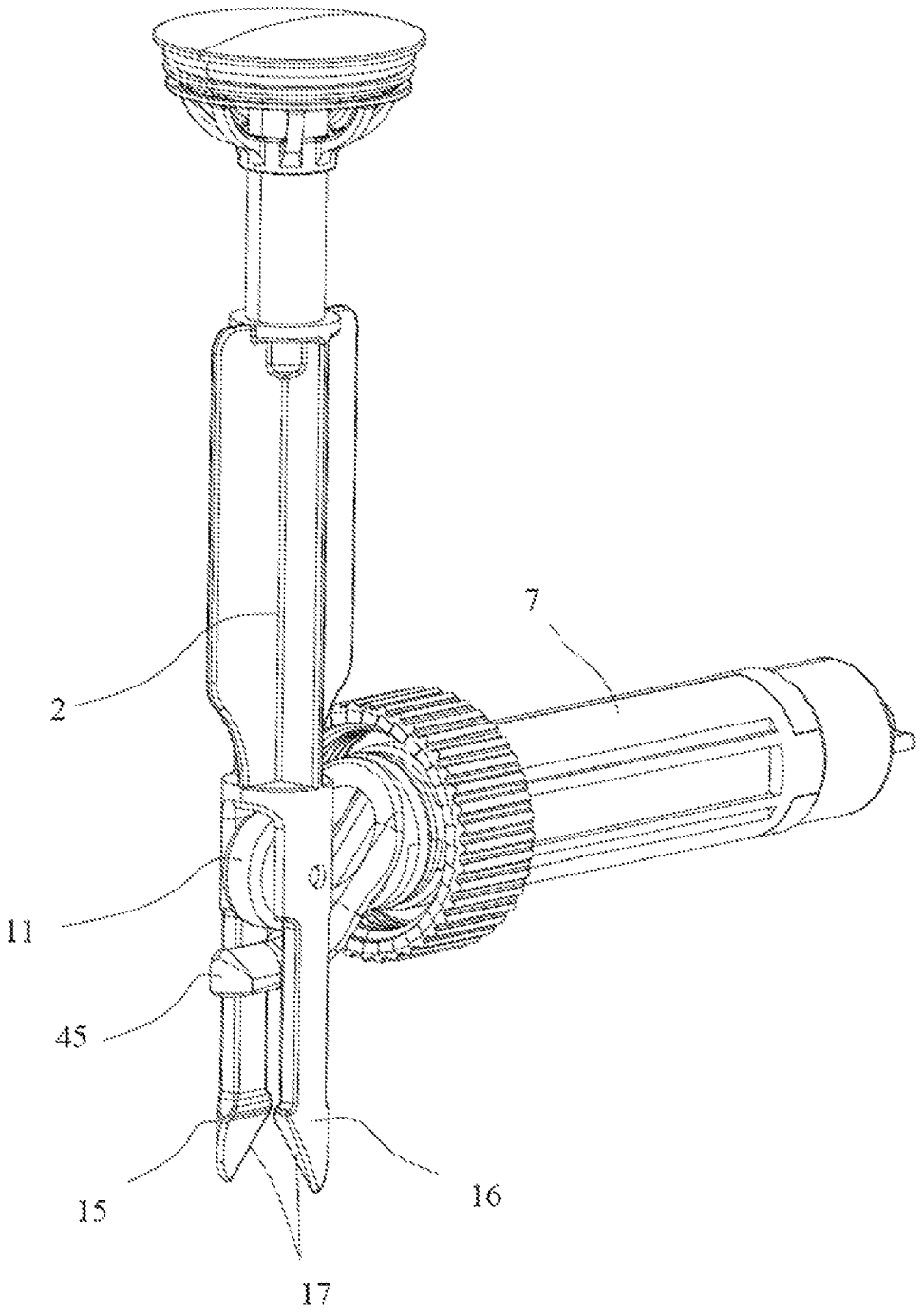
FIG. 17 is a structural schematic of a guiding bar of a drainer fitted into a bayonet according to an embodiment.
Figure 18:
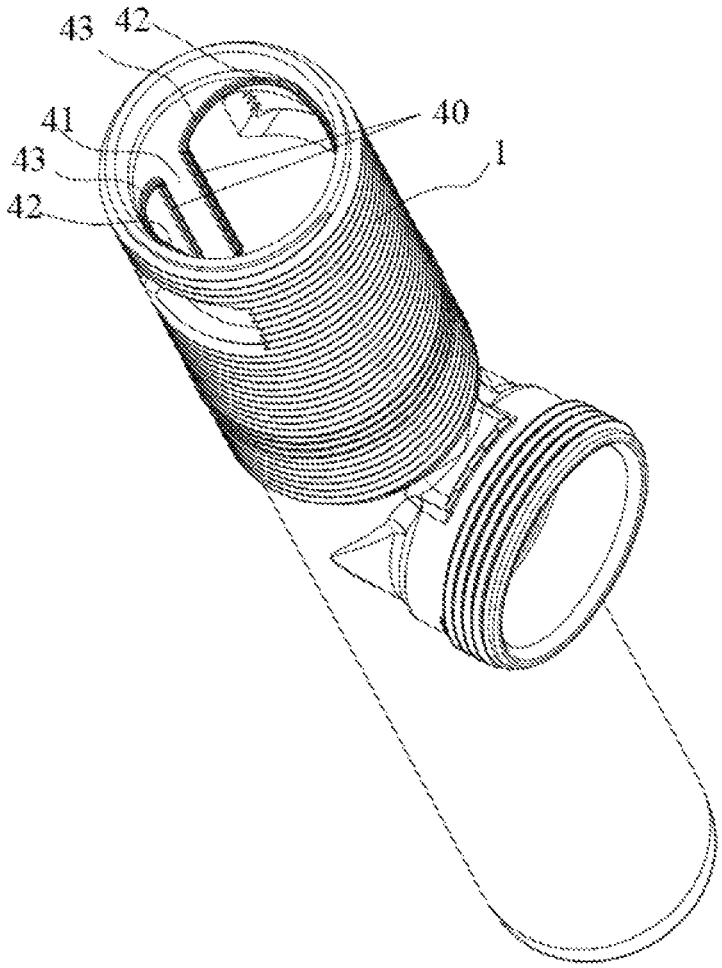
FIG. 18 is a structural schematic of a downcomer of a drainer according to an embodiment.

As shown in FIG. 11-17, a guiding bar 45 matching with the guiding component is arranged on an end of the mounting housing 7 facing the downcomer 1. The guiding bar 45 is below the tilted block 9. The upper surface of the guiding bar 45 is a projecting curved surface. During assembly, the first guiding block 15 and the second guiding block 16 will be the first to contact the guiding bar 45 if the guiding bar 45 is provided. If the bayonet 14 of the elastic snap joint 13 and the guiding bar 45 are not assembled correctly, the guiding faces 17 on the first guiding block 15 and the second guiding block 16 are centrosymmetrically deployed after the guiding faces 17 contact the guiding bar 45. As the first guiding block 15 and the second guiding block 16 are in contact with the guiding bar 45, the guiding faces 17 on the first guiding block 15 and the second guiding block 16 are positioned on the two sides of the guiding bar 45, respectively. The elastic snap joint 13 will rotate due to gravity of the connecting pole 2 and the sewer lid 5 as shown in FIG. 13-14 until it reaches a position where the guiding bar 45 could fit in the bayonet 14 as shown in FIG. 15. After that, a certain amount of force can be applied to pushes the guiding bar 45 into the bayonet 14 and complete the assembly.

In some, embodiments, the driving component allows the sliding block 8 to stay in an arbitrary position during sliding. The driving component provides a smooth, stable, and reversible motion, as well as a power transmission function. In such a way, the sliding block 8 could stay in any desired position during sliding. The sewer lid 5 is actuated by the tilted block 9 and the connecting pole 2 which are driven by the sliding block 8. The staying position of the sewer lid 5 and the covering area of the sewer lid 5 relative to the sewer outlet 3 can be adjusted by operating the driving component. The disclosed configuration is simple to use, and offer an advantage over prior arts which provide a sewer lid switchable only between an open state and a closed state. The driving component can be electrical, such as a pushrod motor controlled by a control switch. The pushrod motor is fixedly connected to the mounting housing 7. The driving component may employ other structures such as a motor driven or electromagnetically driven screw nut mechanism driven by a motor or another structure.

The driving component may comprise a driving block 18, a connecting wire 19 and a driving unit to retract the connecting wire 19. The driving block 18 is slidably arranged within the mounting housing 7. An end of the driving block 18 is connected to the connecting wire 19. The connecting wire 19 is connected to the driving unit. The driving unit actuates the driving block 18 to slide using the connecting wire 19. A rack and pinion transmission component is arranged between the driving block 18 the sliding block 8. The driving block 18 actuates the sliding block 8 to slide by using the rack and pinion transmission component. The driving unit actuates the driving block 18, which then actuates the sliding block 8 to slide by the rack and pinion transmission component. The mechanical structures have a frictional resistance force which causes the sliding block 8 to stay in position when the driving unit stops after a distance. By adjusting the driving unit to different positions, the sewer lid 5 can be kept in different positions, and covering area of the sewer lid 5 relative to the sewer outlet 3 can be adjusted. The covering area can be adjusted conveniently by operating the driving unit. A technical advantage is provided over prior arts which provide a sewer lid switchable only between an open state and a closed state.

The rack and pinion transmission component comprises a first rack 21 arranged on the driving block 18, a second rack 22 arranged on the sliding block 8 and a transmission pinion rotatably arranged within the mounting housing 7. Both the first rack 21 and the second rack 22 are engaged with the transmission pinion.

The driving unit comprises a handle 20 vertically moveable to retract the connecting wire 19 during vertical movements of the handle 20. The transmission pinion comprises a first driving wheel 23, a second driving wheel 24 and a third driving wheel 25 arranged in parallel. The first driving wheel 23 is engaged with the second driving wheel 24. The second driving wheel 24 is engaged with the third driving wheel 25. The length of the second driving wheel 24 is less than the length of the first driving wheel 23 and less than the length of the third driving wheel 25. The first rack 21 is engaged with the first driving wheel 23. The second rack 22 is engaged with the third driving wheel 25. Gaps 26 are arranged on the first rack 21 and the second rack 22 to provide space for the second driving wheel 24. The transmission pinion is devised to comprise a first driving wheel 23, a second driving wheel 24, and a third driving wheel 25. As the handle 20 is pulled upwards, the sliding block 8 slides towards the connecting pole 2 and the tilted block 9 pushes the connecting pole 2 and the sewer lid 5 upwards to open the sewer outlet 3. As the handle 20 is pulled downwards, the sliding block 8 slides away from the connecting pole 2, and the connecting pole 2 and the sewer lid 5 move downwards due to gravity until the sewer outlet 3 is sealed. Having the handle 20 pulled upwards to open the sewer lid 5 and having the handle 20 pulled downwards to close the sewer lid 5 conform to human habits. There should be an odd number of transmission pinions, such as one, three, or five transmission pinions. Additionally, the length of the second transmission pinion 24 is less than the first transmission pinion 23 and the third transmission pinion 25. The gaps 26 arranged on the first and second racks 21, 22 to provide space for the second transmission pinion 24 are devised to ensure coordination of the racks and the pinions in a limited space within the mounting housing 7.

The driving component can be a pushrod motor controlled by a control switch. The pushrod motor is fixedly connected to the mounting, housing 7. The pushrod motor is connected to the connecting wire 19 to retract the connecting wire 19, such that the sewer lid 5 can be opened or closed relatively to the sewer outlet 3, and the opening area of the sewer lid 5 relative to the sewer outlet 3 can be adjusted.

Limiting plugs 27 can be provided on the sliding block 8 and/or the driving block 18. As the sliding block 8 and the driving block 18 move toward each other, the limiting plugs 27 would insert into the gaps 26. In such a way, when the sliding block 8 and the driving block 18 move toward each other and the limiting plugs 27 is abutting the bottom of the gaps 26, a limiting position to provide a spatial limitation is reached which would ensure the sewer lid 5 is in a correct position to seal the sewer outlet 3.

The mounting housing 7 comprises a first housing 28 and a second housing 29 connected to each other. The first housing 28 comprises a pin 31 to rotatably connect to the transmission pinion. The second housing 29 comprises a via 30 arranged correspondingly to the pin 31. The pin 31 is riveted to the second housing 29 through the via 30. Hooks 46 are arranged on two ends of the first housing 28. Connecting grooves 47 are provided on two ends of the second housing correspondingly to the hooks 46. The first housing 28 and the second housing 29 mount to each other to form a mounting housing 7 when the hooks 46 are fitted into the connecting grooves 46. The number of the pin(s) 31 is adapted to the number of the transmission pinion(s) if there are more than one of pins or transmission pinions. The transmission pinion can thus be mounted on the pin 31 immediately the first housing 28 and the second housing 29 are connected to each other. The pin 31 is riveted to the second housing 29 through the via 30 afterwards. Assembly and manufacture efficiencies are greatly enhanced by the embodiment.

The fixation of the mounting housing 7 to the fixing seat 6 can be performed by screwing the mounting housing 7 to the fixing seat 6 with a fastening component 32. A first latch 33 is arranged on the end face of the fixing seat 6. A second latch 34 is arranged on the ends of the fastening component 32. The first latch 33 is engaged with the second latch 34. For example, the first latch 33 comprises teeth inverse to that of the second latch 34. Therefore, the loosening of the fastening component 32 can be avoided when fastening the fastening component 32 to the fixing seat 6, further enhancing robustness of the drainer in usage.

A circumferential limiting structure is provided on the fixing seat and the mounting housing. The circumferential limiting structure comprises notches on the fixing seat and ribs connected to the notches. This configuration avoids rotation of the mounting housing, and ensures stability of the drainer during usage. In another aspect, this configuration ensures an accurate orientation and position of the tilted block when the mounting housing is mounted behind the fixing seat.

A circumferential limiting structure is arranged on the fixing seat 6 and the mounting housing 7. The circumferential limiting structure comprises a notch 35 provided on the fixing seat 6 and a fixing block 36 arranged on the mounting housing. The fixing block 36 is fitted to the notch 35. The configuration can avoid the rotation of the mounting housing 7 and ensure stability of the drainer during usage. In another aspect, the tiled block 9 can be held in the correct direction and position after the mounting housing 7 is mounted behind the fixing seat 6.

The mounting housing 7 is of a square shape. The corresponding sliding block 8 and the driving block 18 are also of square shapes. The rotation of the sliding block 8 and the driving block 18 can thus be prevented, and the traveling trace thereof could be consistent. A liquid-tight structure is arranged between the mounting housing 7 and the fixing seat 6. The liquid-tight structure can comprise a sealing ring 37 connected to an end of the mounting housing facing the fixing seat 6. Another liquid-tight structure can be arranged between the mounting housing 7 and the sliding block 8. The explicit number of sealing rings 37 depends on the actual situation. There could be one, two, three or more sealing rings to avoid leakage.

A filter 38 is provided on the connecting pole 2. The filter 38 filters matter in the cleaning basin to avoid blockage. In an embodiment as shown in FIG. 13, directing components matching with each other are provided on the connecting pole 2 and the downcomer 1. The directing components comprise directing plates 39 arranged on side of the connecting pole 2 and directing ribs 40 arranged on the inner wall of the downcomer 1. Directing grooves 41 are formed between the directing ribs. The directing plates 39 are slidably connected to the directing grooves 41. In such a way, the directing structures direct the vertical movement of connecting pole 2 and avoid movement imbalance. The stability of the drainer during usage can be insured by maintaining consistency of each movement. Further, the directing structures ensure stability by preventing circumferential rotation of the connecting pole 2 during vertical movement. Limiting ribs 42 are deployed circumferentially on the inner face of the downcomer 1 and the outer side of the directing grooves 41. The limiting ribs 42 prevent the directing plates 39 from inserting into the downcomer 1 at the positions of the limiting ribs 42. The farthest distance between limiting ribs 42 is less then minimal distance between the directing plates 39. During assembly the directing plates 39 can only be slidably arranged within the directing grooves 31 since the limiting ribs 42 prevent the directing plates 39 from inserting into the downcomer 1 at the positions of the limiting ribs 42. When fitting the tilted block 9 into the bayonet 14, the presence of the limiting ribs allows a more accurate, more convenient, and more effective assembly. Slide-in guiding ribs 43 are arranged between an end part of the limiting ribs 42 and an end part of the directing ribs 40. The end part of the limiting ribs 42 and the end part of the directing ribs 40 are connected by the slide-in guiding ribs 43. The directing plates 39 can be more easily fitted into the directing grooves 41 for easier assembly by the combined limiting ribs 42.

A workflow is described in an embodiment. As the sliding block 8 slides towards the connecting pole 2, the tilted block 9 pushes the connecting pole 2 upwards which then pushes the sewer lid 5 upwards to open the sewer outlet 3. As the sliding block 8 slides away from the connecting pole 2, the connecting pole 2 and the sewer lid 5 move downwards due to gravity and seal the sewer outlet 3. A structure to lift the connecting pole 2 by a sliding block is applied in the field of drainers. The sewer lid 5 can be opened or closed by controlling the driving component. Draining of water can be completed without wetting a hand in the cleaning basin. Therefore, a beneficial technical advantage is provided. Besides, the user can press the sewer lid 5 down to close it since the sliding block 8 can slide back and forth. This solves a problem in prior arts which restrict that the sewer lid 5 can only be lifted or lowered by a corresponding switch. Damage caused by pressing the sewer lid 5 too hard can be avoided.

Drainers according to disclosed embodiments can be used in washing tubs, kitchen cleaning basins, and lavatory basins.

Although certain embodiments have been illustrated and described herein for purposes of description, a wide variety of alternate equivalent embodiments or implementations to achieve the same purposes may be substituted for the embodiments shown and described without departing from the scope of the present disclosure. This application is intended to cover any adaptations or variations of the embodiments discussed herein.

We claim:

1. A drainer, comprising a downcomer (1), a connecting pole (2), a connecting seat (4) having a sewer outlet (3), and a sewer lid (5) to close or open the sewer outlet (3), wherein the connecting seat (4) is connected to the downcomer (1), wherein the connecting pole (2) is inside the downcomer (1), wherein the sewer lid (5) is connected to an upper end of the connecting pole (2), wherein a fixing seat (6) is arranged on a side wall of the downcomer (1), wherein a mounting housing (7) is fixed to the fixing seat (6), wherein a sliding block (8) is slidably arranged in the mounting housing (7), wherein a tilted block (9) to support the connecting pole (2) is arranged on end of the sliding block (8) facing the connecting pole (2), wherein a driving component to actuate the sliding motion of the sliding block (8) is arranged within the mounting housing (7), wherein the tilted block (9) pushes the connecting pole (2) and the sewer lid (5) upwards to open the sewer outlet (3) when the sliding block (8) slides towards the connecting pole (2), and wherein a pulley (11) rotatably connected to the tilted block (9) is rotatably connected to a lower end of the connecting pole (2).

2. The drainer of claim 1, wherein an elastic snap joint (13) is arranged on a lower end of the connecting pole (2), the elastic snap joint (13) comprises a bayonet (14) connected to the tilted block (9), and the pulley (11) is rotatably arranged within the elastic snap joint (13).

3. The drainer of claim 2, wherein a guiding component to guide the tilted block (9) to enter the bayonet (14) is arranged on a lower end of the elastic snap joint (13).

4. The drainer of claim 2, wherein a guiding bar (45) to match with the guiding component is arranged on an end of the mounting housing (7) facing the downcomer (1), and the guiding bar (45) is below the tilted block (9).

5. The drainer of claim 1, wherein the driving component comprises a driving block (18), a connecting wire (19) and a driving unit to retract the connecting wire (19), the driving block (18) is slidably arranged within the mounting housing (7), an end of the driving block (18) is connected to the connecting wire (19), the connecting wire (19) is connected to the driving unit, the driving unit actuates the driving block (18) to slide using the connecting wire (19), a rack and pinion transmission component is arranged between the driving block (18) the sliding block (8), and the driving block (18) actuates the sliding block (8) to slide through the rack and pinion transmission component.

6. The drainer of claim 5, wherein the rack and pinion transmission component comprises a first rack (21) arranged on the driving block (18), a second rack (22) arranged on the sliding block (8) and a transmission pinion rotatably arranged within the mounting housing (7), and both the first rack (21) and the second rack (22) are engaged with the transmission pinion.

7. The drainer of claim 6, wherein the driving unit comprises a handle (20) vertically moveable to retract the connecting wire (19) during vertical movements of the handle (20), the transmission pinion comprises a first driving wheel (23), a second driving wheel (24) and a third driving, wheel (25) arranged in parallel, the first driving wheel (23) is engaged with the second driving wheel (24), the second driving wheel (24) is engaged with the third driving wheel (25), the length of the second driving wheel (24) is less than the length of the first driving wheel (23) and less than the length of the third driving wheel (25), the first rack (21) is engaged with the first driving wheel (23), the second rack (22) is engaged with the third driving wheel (25), and gaps (26) are arranged on the first rack (21) and the second rack (22) to provide space for the second driving wheel (24).

8. The drainer of claim 5, wherein the mounting housing (7) comprises a first housing (28) and a second housing (29) connected to each other, the first housing (28) comprises a pin (31) to rotatably connect to the transmission pinion, the second housing (29) comprises a via (30) arranged correspondingly to the pin (31), and the pin (31) is riveted to the second housing (29) through the via (30).

9. The drainer of claim 1, wherein the mounting housing (7) is screwed to the fixing seat (6) by a fastening component (32), a first latch (33) is arranged on the end face of the fixing seat (6), a second latch (34) is arranged on the ends of the fastening component (32), and the first latch (33) is engaged with the second latch (34).

* * * * *